US008126184B2

(12) United States Patent
Parker

(10) Patent No.: US 8,126,184 B2
(45) Date of Patent: Feb. 28, 2012

(54) ARTICULATED SPEAKER RIGGING SYSTEM AND METHOD

(76) Inventor: Gary M. Parker, West Palm Beach, FL (US)

( * ) Notice: Subject to any disclaimer, the term of this patent is extended or adjusted under 35 U.S.C. 154(b) by 1228 days.

(21) Appl. No.: 11/779,727

(22) Filed: Jul. 18, 2007

(65) Prior Publication Data

US 2009/0022354 A1 Jan. 22, 2009

(51) Int. Cl.
*H04R 1/02* (2006.01)

(52) U.S. Cl. ..... 381/386; 381/387; 381/395

(58) Field of Classification Search ..... None
See application file for complete search history.

(56) References Cited

U.S. PATENT DOCUMENTS 5,266,751 A 11/1993 Taguchi
5,368,270 A 11/1994 Wiwczar
5,400,412 A 3/1995 King, Sr. et al.
5,433,414 A 7/1995 Vieira
5,758,852 A 6/1998 Martin
5,819,959 A * 10/1998 Martin ..... 211/118
5,996,728 A 12/1999 Stark
6,102,351 A 8/2000 Akrep
6,105,914 A 8/2000 Akrep
6,374,942 B1 4/2002 Huggins
6,640,924 B2 11/2003 Messner
6,708,940 B2 3/2004 Ligertwood
6,721,434 B2 4/2004 Polk, Jr. et al.
6,910,548 B2 6/2005 Powell
6,932,313 B1 8/2005 Akrep
7,000,883 B2 2/2006 Mercadal et al.
7,032,871 B1 4/2006 Akrep
7,130,432 B2 10/2006 Lee et al.
2002/0153195 A1 10/2002 Messner
2003/0231782 A1 12/2003 Engebretson et al.
2006/0163548 A1 7/2006 Kochan et al.
2006/0210095 A1 9/2006 Monitto et al.
2007/0034764 A1 2/2007 Dittmer et al.

OTHER PUBLICATIONS

Polar Focus and ZBeam, "What is ZBeam, and How Does it Make Audio Rigging So Fast?", Polar Focus, Inc., 2003, pp. 1-9.

* cited by examiner

*Primary Examiner* — Brian Ensey
*Assistant Examiner* — Taunya McCarty
(74) *Attorney, Agent, or Firm* — McHale & Slavin, P.A.

(57) ABSTRACT

The invention involves a system and method for securing one or more loudspeakers to an overhead structure. The system includes up to six axes about which the speaker(s) can be rotated and/or traversed to provide the desired pan, tilt and rotational splay angle to the speaker.

13 Claims, 12 Drawing Sheets

ARTICULATED SPEAKER RIGGING SYSTEM AND METHOD

FIELD OF INVENTION

The present invention generally relates to loudspeaker rigging systems and more particularly to rigging hardware for suspending a single or an array of loudspeakers at a predetermined location relative to an audience. The present invention has particular application in rigging a permanent array of loudspeakers wherein the pan, tilt and rotational splay angles between loudspeakers is desired to achieve a desired coverage and acoustic performance. The system is adapted to cooperate with pre-existing and/or new speakers for attachment to horizontal, vertical or intermediate angled surfaces.

BACKGROUND INFORMATION

Sound systems for large temporary venues typically involve the suspension or "flying" of stacks of loudspeaker in various arrays to achieve the necessary acoustic output and coverage for a large audience. Such arrays of loudspeakers are typically suspended and held together by rigging systems which can be attached to rigging hoists which position the stack at a desired elevation and location, typically above or in the vicinity of a performance stage. A flown stack of loudspeakers can include many speaker boxes, and the rigging system for flying the stack must be strong enough to support the enormous weight of the loudspeakers. Such rigging systems generally involve the use of metal framing elements secured to the speaker boxes that can be used to link the speakers together in an array and to lift the loudspeaker array to an overhead flying position.

Often the design requirements of a sound system will require that the individual speaker boxes be arranged in a horizontal array or vertical stack so that they are angled relative to each other, e.g splayed with respect to each other. Setting the proper splay angle can be critical to achieving the desired acoustic performance while minimizing interference between the acoustic outputs of other speakers in the array. Splay angles, are generally provided by adjusting the linkage lengths between the frames of the stacked speakers to create a desired angle. One existing approach for accomplishing this is to provide a relatively long chain linkage at the front corners of the speakers while providing a short link at the back of the speakers. When the speakers are hoisted overhead to their flown position, additional linkages are used to pull tension on the chains to provide the loudspeaker splay angles. The drawback with this type of system is that additional linkages greatly increase the difficulty of the installation, particularly when the speaker stack includes a large number of speakers.

Another known approach to creating a desired splay angle is to use straight, rigid extension bars to link the front or rear corners of the speaker's rigging frames. Such extension bars have locator holes distributed along their length for achieving different separations between the speaker corners, and can be exchanged with other extension bars with shifted locator holes such that one bar can be used to achieve intermediate splay angles provided by another bar. One problem with such extension bars is that they are often misplaced or lost, and are cumbersome to install. Another difficulty is that the degree of adjustment of the splay angle for any given bar is inherently limited by the size and separation of their locator holes necessary to maintain component strength.

An additional drawback to the prior art relates to unforeseen acoustics within a particular structure. Should the acoustics provided by the array not perform as anticipated, all or portions of the array may have to be disassembled to modify the splay of the speakers. This often necessitates lowering the speakers so that they can be repositioned with respect to each other.

Finally, there are ergonomic needs that a speaker mounting system must satisfy in order to achieve acceptance by the end user. The system must be easily and quickly assembled using minimal hardware and requiring a minimal number of tools. Further, the system should not require excessive strength to assemble or include heavy component parts. Moreover, the system must assemble together in such a way so as not to detract from the aesthetic appearance of the suspended speaker(s) array.

Thus, the present invention provides a rigging system for loudspeakers which overcomes the disadvantages of prior art rigging systems. The rigging system of the present invention not only provides for relative ease in the assembly and flying of an array of loudspeakers, it also permits full adjustment of the pan, tilt and rotational splay angles of the loudspeakers without the need to exchange parts. The present invention also provides a rigging system which holds the separation and splay angle between speaker boxes, thereby eliminating the need for exchanging parts or additional linkages.

SUMMARY OF THE INVENTION

Briefly, the invention involves a system and method for securing one or more loudspeakers to an overhead structure. The system includes up to six axes about which the speaker(s) can be panned, tilted, rotated and/or traversed to provide the desired vertical and horizontal splay angle to the speaker. The system preferably includes a first gimbal that is securable to the structure, preferably overhead, and includes two axes of movement. A vertical member extends downwardly from the first gimbal to a swivel which provides rotation about a third axis. The swivel attaches to a tilt traveler assembly which provides two axes of rotation. The tilt traveler assembly is slidably mounted along a contoured axial track member that extends around the top and back of the speaker box to provide an axis along which the speaker can be traversed. The front portion of the axial track member includes a rotation traveler assembly and screw link, slidably secured along a transverse track member, which provides an additional axis along which the speaker can be traversed for rotational splay angle adjustment of the speaker. The screw link cooperates with a threaded rod mounted substantially parallel to the transverse track member, whereby rotation of the threaded rod traverses the rotation traveler assembly bi-directionally across the transverse track member. The construction of the mounting system allows the pan, tilt and rotational splay angles to be adjusted without disassembly of the system.

Accordingly, it is an objective of the present invention to provide an Articulated Speaker Mounting System and Method.

It is a further objective of the present invention to provide a speaker mounting system for overhead suspension of audio equipment.

It is yet a further objective of the present invention to provide a speaker mounting system that provides multiple axes about which the speaker may be panned, tilted, rotated or traversed for adjusting speaker splay.

It is another objective of the instant invention to provide a speaker mounting system that allows for adjustment of the pan, tilt and rotational aspects of speaker splay angles without disassembly of the speaker hanger.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
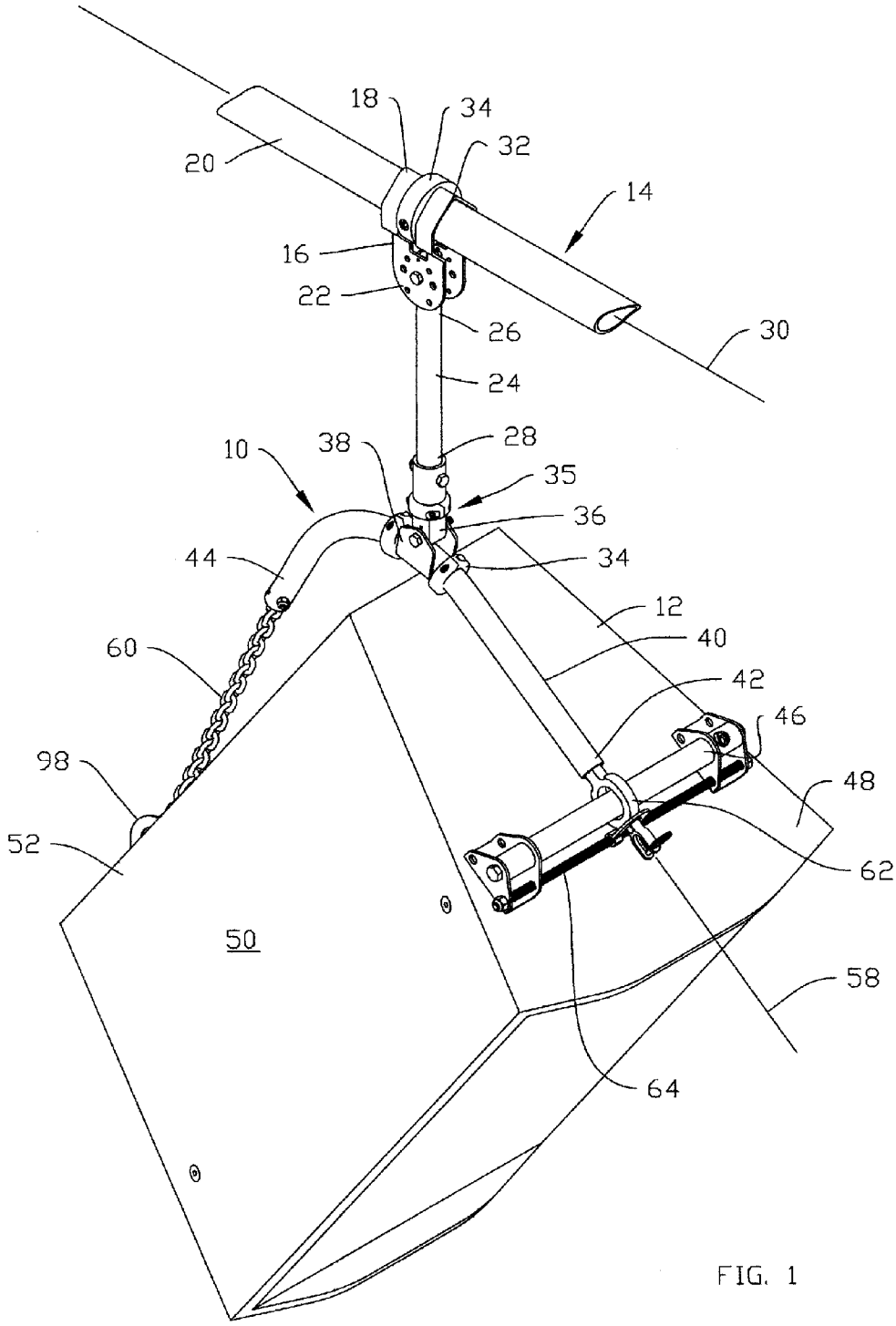
FIG. 1 is a top perspective view of one embodiment of the instant invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Referring generally to FIGS. 1,10-12, a rigging system 10 for securing a speaker enclosure 50 to a structure 14 is illustrated. The system includes a first gimbal 16 having a first end 18 constructed and arranged to cooperate with a support member 20 for securing the gimbal to the support structure and a second end 22 constructed and arranged to cooperate with a vertical support member 24. The support member 20 provides a first axis 30 along which the gimbal 16 may be rotated and traversed. In a most preferred embodiment, the first end 18 of the gimbal 16 is constructed as a pair of spaced apart loops 32 each constructed and arranged to extend around the overhead support member 20 and spaced apart sufficiently to accept a collar assembly 34 therebetween. The collar assembly 34 includes an inner diameter that is constructed and arranged to selectively engage the overhead support member 20. While in an engaged position, the collar assembly 34 prevents traversal of the gimbal along the first axis 30 while allowing the gimbal to rotate about the first axis. If traversal of the gimbal is desired, the collar assembly 34 is disengaged from the support member and traversed to the desired position prior to re-engaging the collar assembly to the support member. The second end 22 of the gimbal 16 includes a pivot pin 54 defining a second axis 56 about which the vertical member 24 may pivot.

Still referring to FIGS. 1,4-6,10-12, the vertical member 24 includes a first end 26 and a second end 28. The first end 26 of the vertical member is secured to the second end 22 of the gimbal 16 while the second end 28 includes a swivel assembly 82 defining a third axis 84 about which the tilt traveler assembly 35 may be rotated.

The tilt traveler assembly 35 includes a first end 36 constructed and arranged for connection to the second end 28 of the vertical member 24 and a second end 38 pivotably connected to said first end portion via a pin 85 defining a fourth axis 86 and constructed and arranged to cooperate with an axial track 40 for selective traversal there along. In a preferred embodiment a pair of collars 34 are utilized to prevent the traveler assembly from traversing the axial track 40, once in a final position, while still allowing rotation there about. The axial track is preferably round in shape and includes a first end 42 and a second end 44. The first end 42 of the axial track is secured for traversal along a transverse track 46 while the second end 44 is secured to a rear portion 52 of the speaker enclosure 50 so that the axial track extends along the top and rear surfaces of the speaker enclosure. The axial track defines a fifth axis 58 along and about which the tilt traveler 35 may be traversed and/or rotated for adjusting the splay angle of the speaker enclosure 50. In a most preferred embodiment, the axial track 40 is tubular in construction and includes a chain 60 extending through the hollow central portion of the tubular axial track. Generally, the chain 60 includes a length sufficient to extend outwardly from at least one or both of the first 42 and/or second ends 44 for connection to the speaker enclosure 50. Connected to the chain 60 at the first end 42 of the axial track 40 is a rotation traveler assembly 62. The rotation traveler assembly 62 is constructed and arranged to cooperate with the transverse track 46 as well as a threaded rod 64 for allowing rotational splay adjustment of the enclosure 50. The rotation traveler assembly 62 includes a tubular, or other suitably shaped, end 66 that is constructed and arranged to cooperate with the transverse track 46. A generally U-shaped follower member 68 having at least one threaded portion 70 is provided for engaging the threaded rod 64. The threaded rod 64 is secured substantially parallel to the transverse track 46, whereby rotation of the threaded rod 64 in a first direction causes the first end 42 of the axial track 40 to traverse across the transverse track 46 in a first direction and rotation of said threaded rod 64 in a second direction causes the first end 42 of the axial track 40 to traverse across the transverse track 46 in a second direction. The rotation traveler assembly also includes a chain slot 67 and pin 71 for adjusting the position of the tilt traveler assembly 35 with respect to the axial track 40 while the pin 71 is constructed and arranged to enclose said chain slot.

Referring to 1-4 and 7-9, the transverse track 46 defines a sixth axis 74 for traversal of the axial track. The transverse track 46 is preferably secured to the front portion 48 of said speaker enclosure 50 via cabinet brackets 76. The cabinet brackets 76 are secured to the speaker enclosure(s) by suitable fasteners as is well known in the art. It should also be noted that the cabinet brackets may be attached to the speaker enclosure with adhesives, dovetails, integral formation or any suitable combination thereof without departing from the scope of the invention. The cabinet brackets 76 are generally U-shaped when viewed from the end. One upstanding leg 77 includes an aperture 78 sized and shaped to accept the transverse track 46 while the other leg includes an aperture sized to accept a fastener 80. It should be appreciated that the vertical member will typically remain in a vertical orientation and pointed directly at the speaker enclosure's 50 center of mass due to the cooperation between the upper gimbaled connection formed by axes 30 and 56 and the lower gimbaled connection formed by axes 58 and 86.

Figure 2:
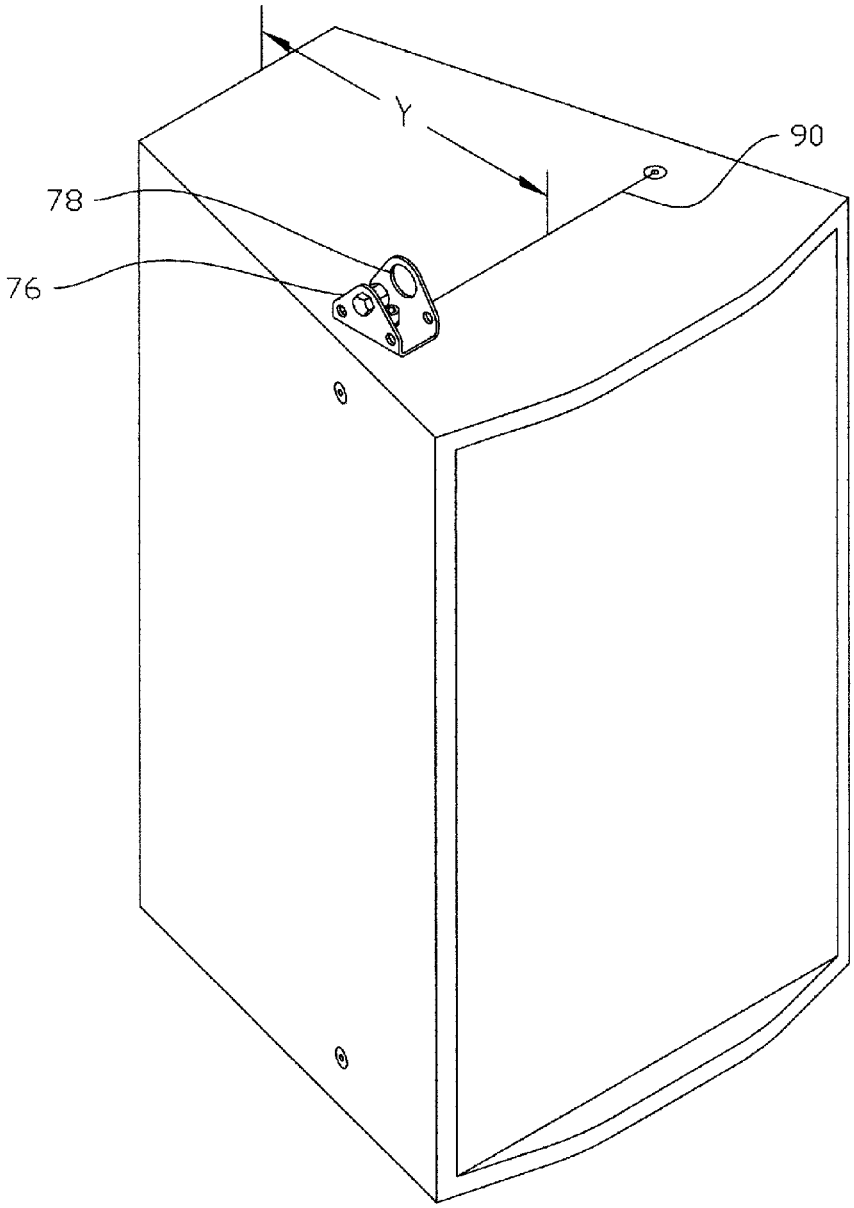
FIG. 2 is a partial top perspective view of the embodiment shown in FIG. 1 illustrating assembly of a cabinet bracket to a rigging point of a speaker enclosure.
Figure 3:
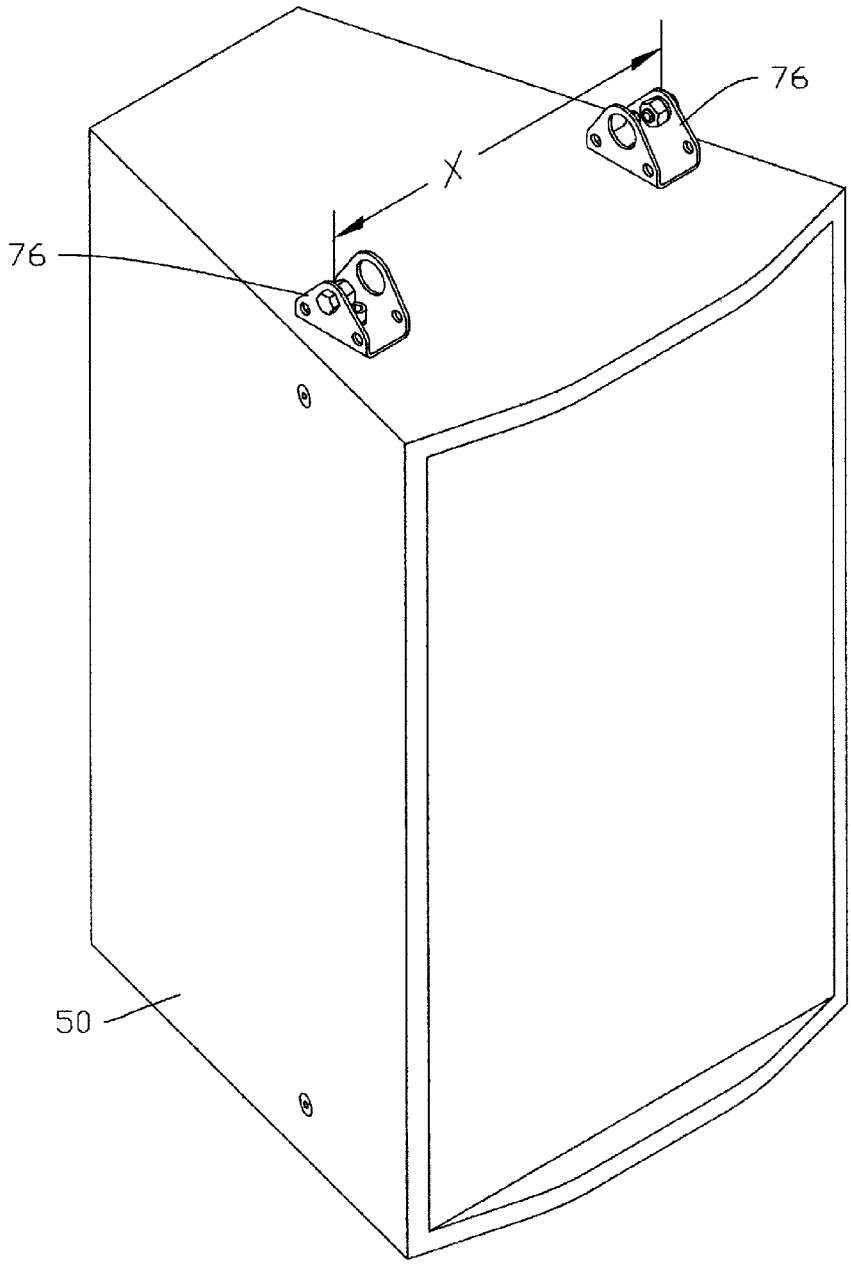
FIG. 3 is a partial top perspective view of the embodiment shown in FIG. 1 illustrating assembly of a second cabinet bracket to a rigging point of a speaker enclosure.
Figure 4:
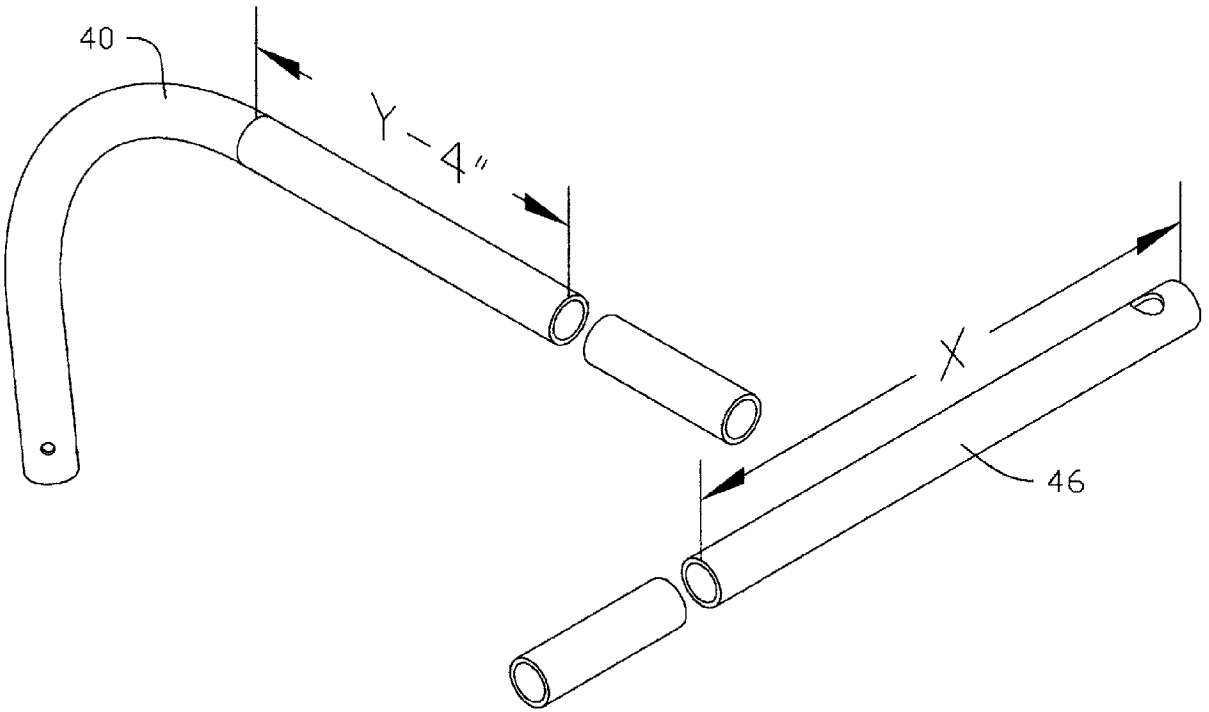
FIG. 4 is a partial perspective view of the transverse and axial tubes of the instant invention.
Figure 5:
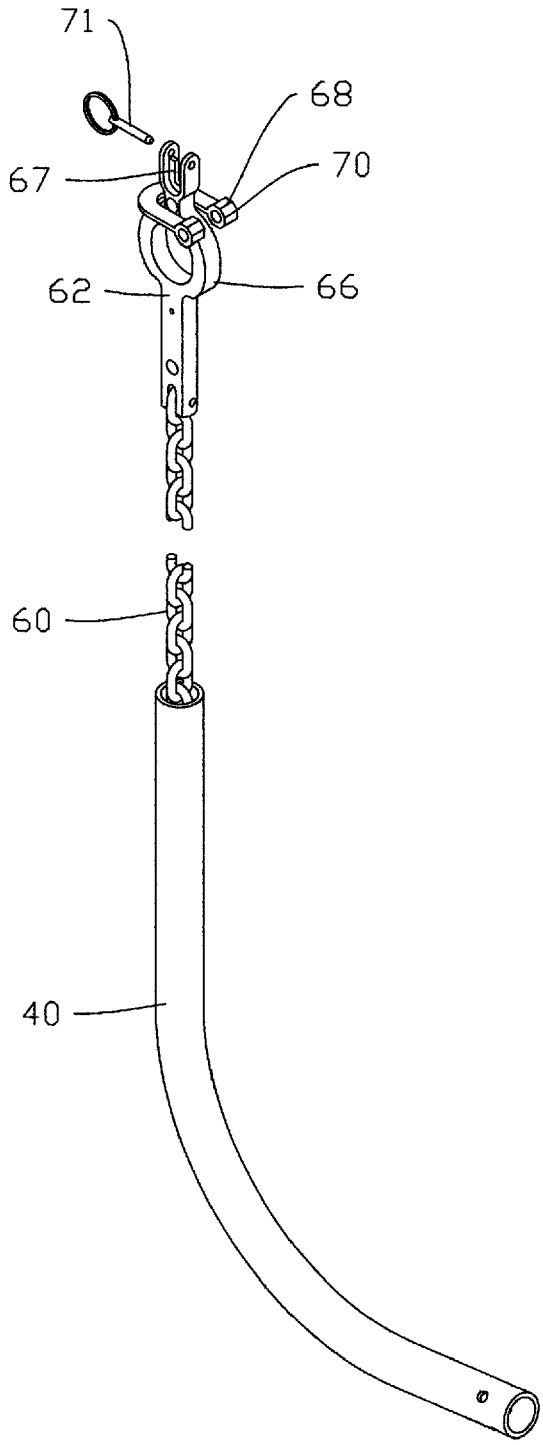
FIG. 5 is a partial perspective view illustrating the axial tube in combination with the traveler assembly.
Figure 6:
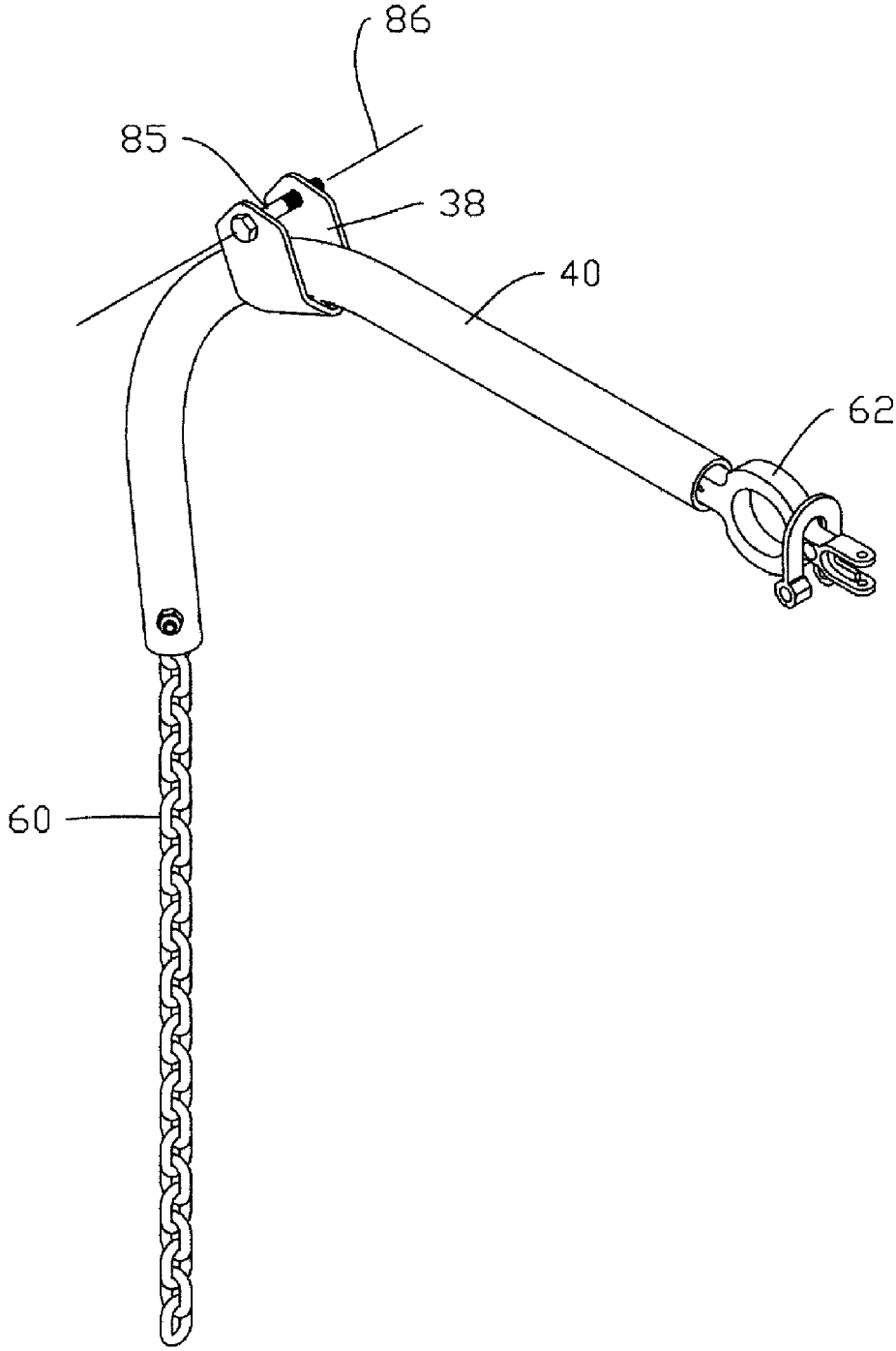
FIG. 6 is a partial perspective view illustrating the axial tube in combination with the traveler assembly and a portion of the tilt traveler.

Referring to FIGS. 1-12, assembly of the instant invention is illustrated. The instant invention may be sold pre-assembled or may be sold in the form of a kit. FIG. 2 illustrates assembly of the cabinet bracket to the speaker enclosure. In general, the speaker manufacturer's rigging points, or other suitable points, are utilized for attachment of the cabinet brackets. One cabinet bracket is installed and line 90 is drawn between the centers of the rigging points to be used for measuring length "Y". The other cabinet bracket is temporarily attached (FIG. 3) and the length "X" between the inside faces of the outer upstanding legs 77 is measured. FIG. 4 illustrates trimming the transverse and axial tracks to the proper length. The transverse track is cut to measured length "X" while the axial tube is cut to measured length "Y" minus 4 inches. FIG. 5 illustrates assembly of the chain 60 and rotation traveler assembly 62. The chain 60 is attached to the rotation traveler assembly 62 such that the chain is vertical and free of twists or bends. The chain 60 is inserted and lowered into the cut end of the axial track 40 until the rotation traveler rests against the first end 42 of the axial track and the chain extends out of the second end as shown in FIG. 6.

Figure 7:
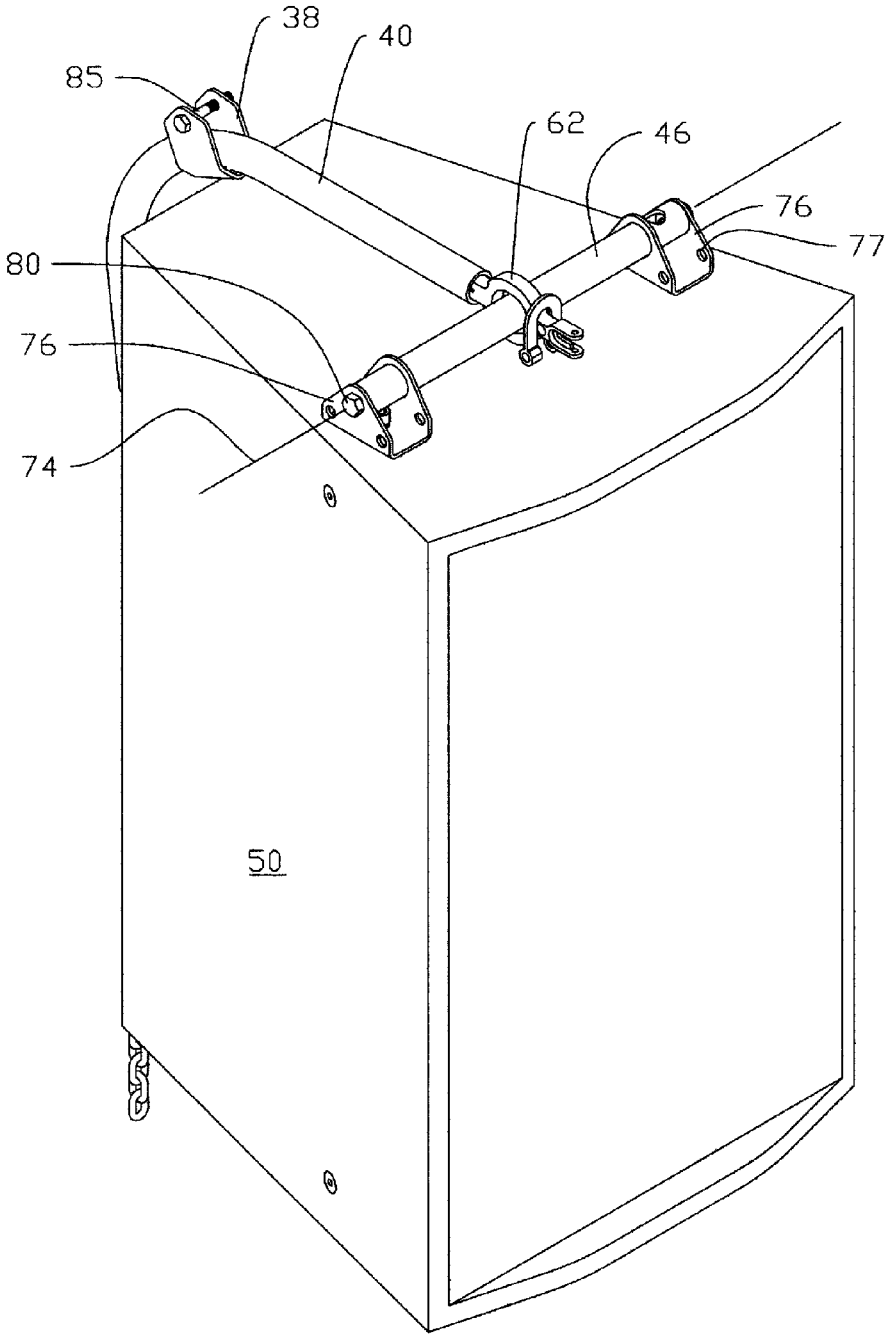
FIG. 7 is a partial perspective view illustrating the axial tube, the traveler assembly and a portion of the tilt traveler secured to a speaker enclosure.
Figure 8:
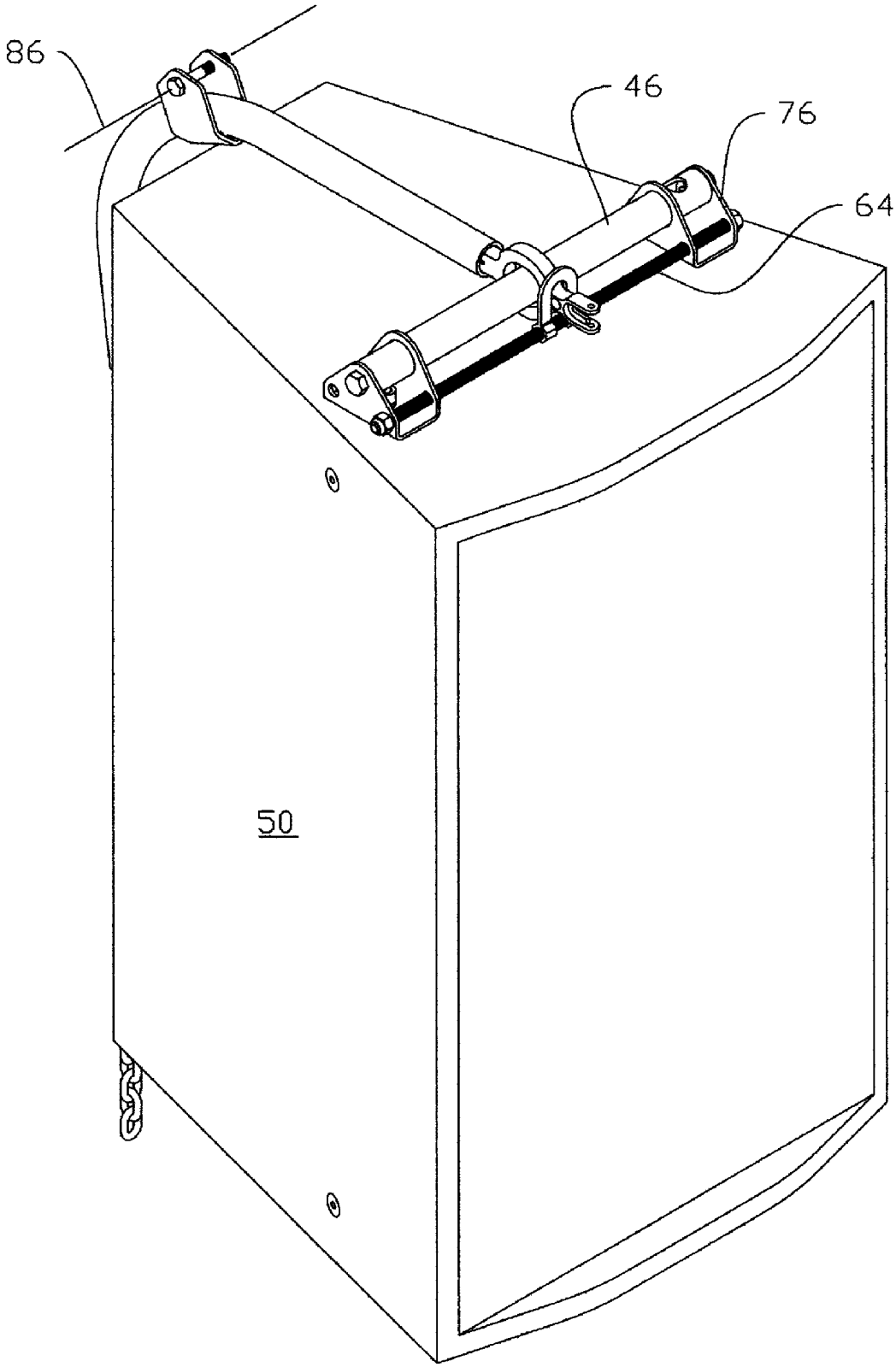
FIG. 8 is a partial perspective view illustrating the axial tube, the traveler assembly along with the threaded rod and a portion of the tilt traveler secured to a speaker enclosure.
Figure 9:
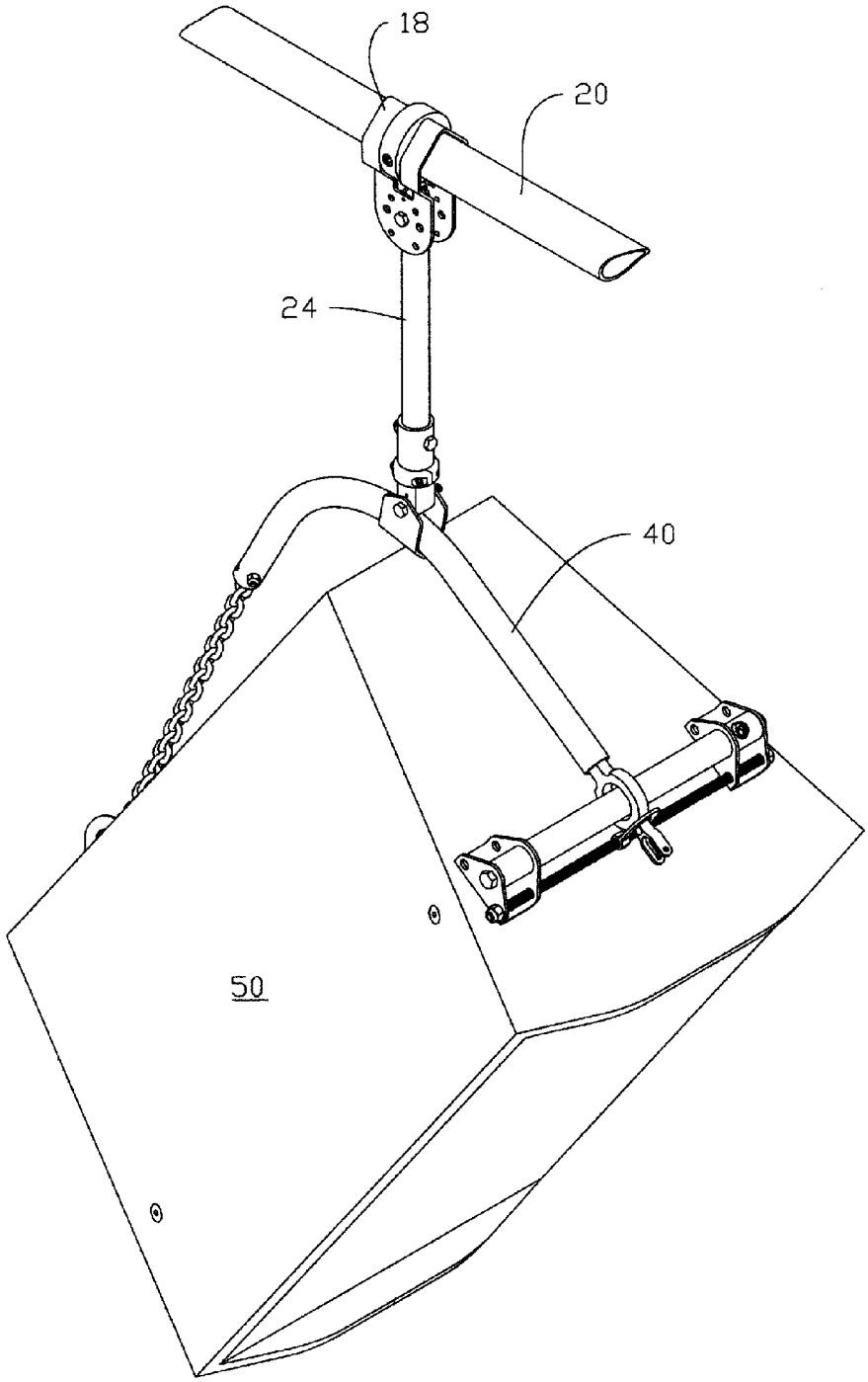
FIG. 9 is a perspective view illustrating an assembled view of one embodiment of the instant invention.

FIGS. 7 and 8 illustrate final installation of the transverse and axial tracks. In this step, one of the cabinet brackets 76 is removed and the transverse track 46 is installed with the rotation traveler assembly 62 in place. The cabinet bracket is then reinstalled. The threaded rod 64 is then cut to length to extend through the cabinet brackets. Lock nuts or other suitable end members are engaged to the threaded rod to hold the rod in place. It should be noted that rotation of the threaded rod causes traversal of the rotation traveler assembly 62 and thus the axial track across the transverse track. The distal end of the chain 60 is then attached to an anchor bracket 98 (FIG. 1) at a rigging point on the lower rear surface of the speaker enclosure.

Figure 10:
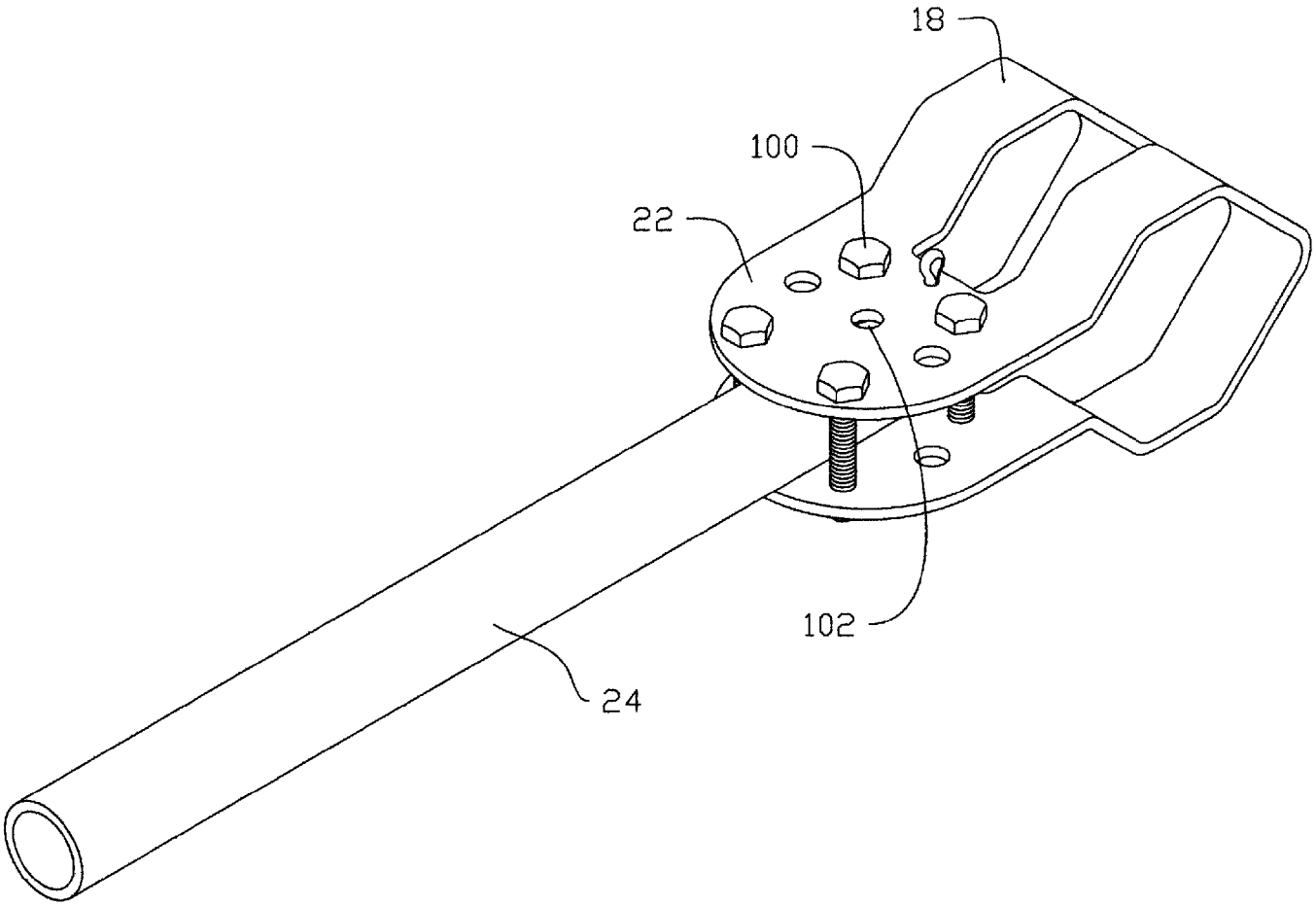
FIG. 10 is a perspective view illustrating the first gimbal and vertical member.
Figure 11:
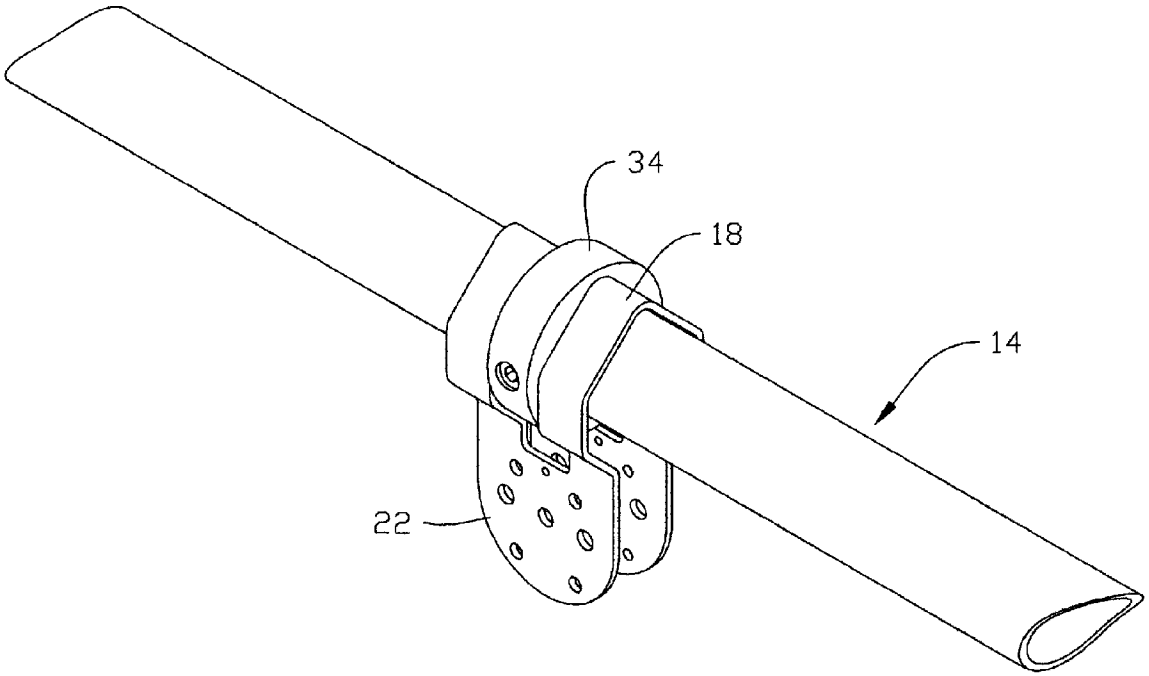
FIG. 11 is a perspective view illustrating the first gimbal cooperating with an overhead support member.
Figure 12:
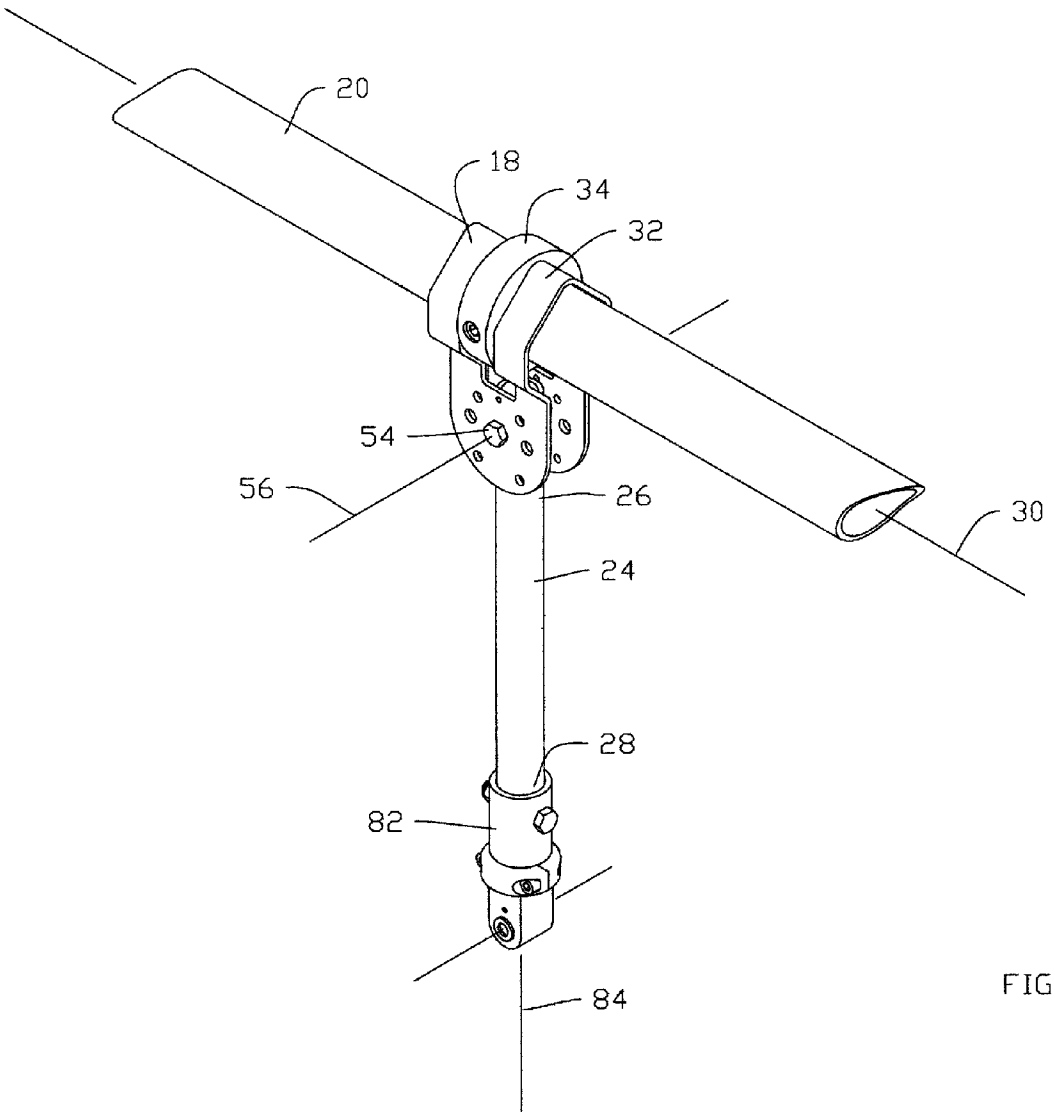
FIG. 12 is a perspective view illustrating the first gimbal, vertical support member and a portion of the tilt traveler assembly cooperating with an overhead support member.

FIG. 10 illustrates assembly of the vertical member 24 to the second end 22 of the gimbal 16. The vertical member 24 is cut to length and placed within the second end of the gimbal prior to tightening fasteners 100. Using aperture 102 as a guide, a drill (not shown) is used to drill through the vertical member 24 from either or both sides. Bolts 100 can then be removed and discarded. The gimbal and collar can then be installed onto the support member as illustrated in FIG. 11. Thereafter, the vertical member is attached to the gimbal 16 via fastener 54, and the swivel 82 is attached to the second end of the vertical member as well as the first portion 36 of the tilt traveler 35. The speaker enclosure 50 is then hoisted into place and second portion of the tilt traveler is secured to the first portion. A chain hoist (not shown) such as a HARRINGTON® LX003 or CM 602 can be secured between the chain slot of the rotation traveler and the tilt traveler assembly 35 to adjust the position of the tilt traveler along the axial track prior to final tightening of the collars 34. It should be appreciated that adjusting the tilt traveler and the rotation traveler determines which spot on the exterior of the speaker enclosure 50 is brought in line between the end of the vertical member and the speaker's center of mass and thus determines the speaker's aiming relative to tilt and rotation while horizontal splay is accomplished by rotating speaker enclosure about the swivel axis 84. It should also be appreciated that as the rotation traveler is adjusted via the threaded rod 64 and screw link 68, the axial tube will change its angular relationship with respect to the transverse tube 46. As the rotation angle increases, the rotation traveler will rotate inside of the axial track to compensate for the changing relationship between the transverse track and the axial track. The construction of the assembly allows the splay angle of the speaker enclosure 50 to be infinitely adjusted and fixed while still allowing moveable pivot points in the assembly whereby the weight of the speaker maintains tension in the assembly.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A rigging system for securing a speaker enclosure to a support structure comprising:

a gimbal having a first end constructed and arranged to cooperate with a support member for securing said gimbal to said support structure and a second end constructed and arranged to cooperate with a vertical member, said vertical member having a first end and a second end, said first end of said vertical member secured to said second end of said gimbal, said second end secured to a tilt traveler assembly, said tilt traveler assembly including a first end constructed and arranged for connection to said second end of said vertical member and a second end constructed and arranged to cooperate with an axial track for selective traversal there along, said axial track including at least one curve which extends at least partially along a top surface and at least partially along a rear surface of said speaker enclosure, whereby traversal of said tilt traveler assembly along said axial track provides tilting directional rotation of said speaker enclosure, said axial track having a first end and a second end, said first end of said axial track being secured for traversal along a transverse track secured to a front portion of said speaker enclosure, said second end being secured to a rear portion of said speaker enclosure, whereby traversal of said first end of said axial track along said transverse track provides directional rotation of said speaker enclosure;

whereby said speaker enclosure is provided with multiple axes of movement while suspended from a single vertical member.

2. The rigging system of claim 1 wherein said support member provides a first axis along which said gimbal may be rotated and traversed.

3. The rigging system of claim 2 wherein said first end of said gimbal is constructed and arranged to cooperate with at least one collar assembly to prevent traversal of said gimbal along said first axis while still allowing rotation about said first axis.

4. The rigging system of claim 2 wherein said first end of said gimbal is constructed as a loop to extend around said overhead support member.

5. The rigging system of claim 2 wherein said first end of said gimbal is constructed as a pair of spaced apart loops each constructed and arranged to extend around said overhead support member and spaced apart sufficiently to accept a collar assembly therebetween, said collar assembly having an inner diameter constructed and arranged to selectively engage said overhead support member, whereby said collar prevents traversal, while allowing rotation, of said gimbal along said overhead support member while in an engaged position and allows traversal of said gimbal along said overhead support member while in a disengaged position.

6. The rigging system of claim 2 wherein said second end of said gimbal includes a pivot pin defining a second axis about which said vertical member may pivot.

7. The rigging system of claim 1 wherein said second end of said vertical member includes a swivel assembly defining a third axis, said tilt traveler assembly secured to said swivel assembly for rotation about said third axis.

8. The rigging system of claim 1 wherein said tilt traveler assembly includes a first end portion constructed and arranged for connection to said second end of said vertical member and a second end pivotably connected to said first end portion via a pin defining a fourth axis, said second end being constructed and arranged to cooperate with an axial track defining a fifth axis along and about which said second portion of said tilt traveler may be traversed.

9. The rigging system of claim 8 wherein said axial track is a round member in cross section and is constructed and arranged to extend along an upper surface and a back surface of said speaker enclosure.

10. The rigging system of claim 9 wherein said axial track is tubular in construction and includes a chain extending through the hollow central portion of the tubular axial track, said chain having a length sufficient to extend outwardly from at least one of said first or second ends for connection to said speaker enclosure.

11. The rigging system of claim 10 wherein said first end of said axial track includes a rotation traveler assembly, said rotation traveler assembly being constructed and arranged to cooperate with said transverse track for traversal there along, said transverse track defining a sixth axis.

12. The rigging system of claim 11 wherein said rotation traveler assembly is constructed and arranged to cooperate with a threaded rod, said threaded rod secured substantially parallel to said transverse track, whereby rotation of said threaded rod in a first direction causes said first end of said axial track to traverse across said transverse track in a first direction and whereby rotation of said threaded rod in a second direction causes said first end of said axial track to traverse across said transverse track in a second direction.

13. The rigging system of claim 11 wherein said rotation traveler assembly includes a chain slot and pin, said pin being constructed and arranged to enclose said chain slot.

* * * * *